US008869455B1

(12) United States Patent
McFall

(10) Patent No.: US 8,869,455 B1
(45) Date of Patent: Oct. 28, 2014

(54) FLOOD GATE SYSTEM FOR DOORWAYS

(71) Applicant: Azeal J. McFall, Nassau (BS)

(72) Inventor: Azeal J. McFall, Nassau (BS)

( * ) Notice: Subject to any disclaimer, the term of this patent is extended or adjusted under 35 U.S.C. 154(b) by 0 days.

(21) Appl. No.: 14/167,133

(22) Filed: Jan. 29, 2014

Related U.S. Application Data

(60) Provisional application No. 61/903,477, filed on Nov. 13, 2013.

(51) Int. Cl.
*E06B 7/18* (2006.01)

(52) U.S. Cl.
USPC ..... 49/466; 52/208; 52/408

(58) Field of Classification Search
USPC ..... 49/463, 466; 52/208, 204.62, 204.71, 52/408, 204.5, 204.6, 169.14, 202, 204, 63
See application file for complete search history.

(56) References Cited

U.S. PATENT DOCUMENTS

| | | | | |
|---|---|---|---|---|
| 3,861,081 | A * | 1/1975 | Maskell | 49/70 |
| 4,136,995 | A | 1/1979 | Fish | |
| 4,682,443 | A * | 7/1987 | Demo | 49/466 |
| 5,077,945 | A * | 1/1992 | Koeniger | 52/169.14 |
| 5,645,373 | A | 7/1997 | Jenkins | |
| 5,943,832 | A * | 8/1999 | Russell | 52/202 |
| 6,427,396 | B1 * | 8/2002 | Harrison | 52/202 |
| D470,252 | S * | 2/2003 | Castrey | D25/138 |
| 6,591,553 | B1 * | 7/2003 | Vaughn | 49/466 |
| 7,410,325 | B1 * | 8/2008 | Nelson et al. | 405/104 |
| 7,523,589 | B1 * | 4/2009 | Smith | 52/202 |
| 7,549,252 | B2 * | 6/2009 | Vaughn | 49/466 |
| 8,287,209 | B2 | 10/2012 | Feldman et al. | |
| 8,650,817 | B2 * | 2/2014 | Helton | 52/208 |
| 2002/0104275 | A1 * | 8/2002 | Harrison | 52/202 |
| 2005/0276661 | A1 * | 12/2005 | Denson et al. | 405/87 |

FOREIGN PATENT DOCUMENTS

| | | | | |
|---|---|---|---|---|
| EP | 2290188 | A1 * | 3/2011 | |
| EP | 2607601 | A1 * | 12/2012 | E06B 9/00 |
| GB | 2318145 | A * | 4/1998 | E04H 9/14 |
| GB | 2381031 | A * | 4/2003 | E06B 9/00 |
| GB | 2383071 | A * | 6/2003 | E06B 9/00 |
| GB | 2392702 | A * | 3/2004 | E06B 9/00 |
| GB | 2453919 | A * | 4/2009 | E06B 9/02 |
| GB | 2458211 | A * | 9/2009 | E06B 9/00 |

* cited by examiner

*Primary Examiner* — Jerry Redman
(74) *Attorney, Agent, or Firm* — Robert C. Montgomery; Montgomery Patent & Design

(57) ABSTRACT

A flood gate system for a doorway utilizes a frame having a slide panel guide located at lateral and bottom edges thereof. A slide panel is slidably adjusted within the slide guides. The slide panel guides, perimeter edges of the frame, and bottom of the slide panel are provided with seals to provide a waterproof abutment and securement of the system. The slide panel guide is permanently affixed to the front frame of a doorway and sealed to the structure supporting the doorway frame. When floodwaters become imminent, the slide panel is inserted into the slide panel guide and slid down to provide a waterproof gate for the doorway.

1 Claim, 3 Drawing Sheets

FLOOD GATE SYSTEM FOR DOORWAYS

RELATED APPLICATIONS

The present invention was first described in and claims the benefit of U.S. Provisional Application No. 61/903,477, filed Nov. 13, 2013, the entire disclosures of which are incorporated herein by reference.

FIELD OF THE INVENTION

The present invention relates generally to a flood gate system placed in front of a doorway and sealed to a structure supporting the doorway. When floodwaters become imminent, the slide panel is inserted into the slide panel guides and slid down to provide a waterproof gate.

BACKGROUND OF THE INVENTION

When disaster strikes, every second counts in preventing the loss of life or property. This is especially the case when dealing with floods where water can rise at alarming rates, engulfing entire towns, and destroying family belongings that have been collected over many generations. As a result, family heirlooms such as photographs, antiques, and other irreplaceable items risk being lost forever, without hope for recovery. This being the case, people are willing to go to great lengths to ensure the safety of their homes and belongings during floods caused by hurricanes, tornadoes, and floods. Unfortunately, with the exception of sandbags, dikes, and massive construction projects, there is little that can be done to protect ones home or building against the ravages of a flood. Accordingly, there is a need for a means by which flood waters from natural disasters can be restricted from buildings and homes, in a manner that is quick, easy, and effective while doing it in a cost-effective manner.

SUMMARY OF THE INVENTION

The disadvantages of the prior art are overcome by the present invention in providing a flood gate system for a doorway utilizes a frame having a slide panel guide located at lateral and bottom edges thereof. A slide panel is slidably adjusted within the slide guides. The slide panel guides, perimeter edges of the frame, and bottom of the slide panel are provided with seals to provide a waterproof abutment and securement of the system. The slide panel guide is permanently affixed to the front frame of a doorway and sealed to the structure supporting the doorway frame. When floodwaters become imminent, the slide panel is inserted into the slide panel guide and slid down to provide a waterproof gate for the doorway. The use of the flood gate system safely controls flood waters at a doorway resulting from natural disasters, in a manner that is quick, easy, and effective, thus protecting personal property and belongings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
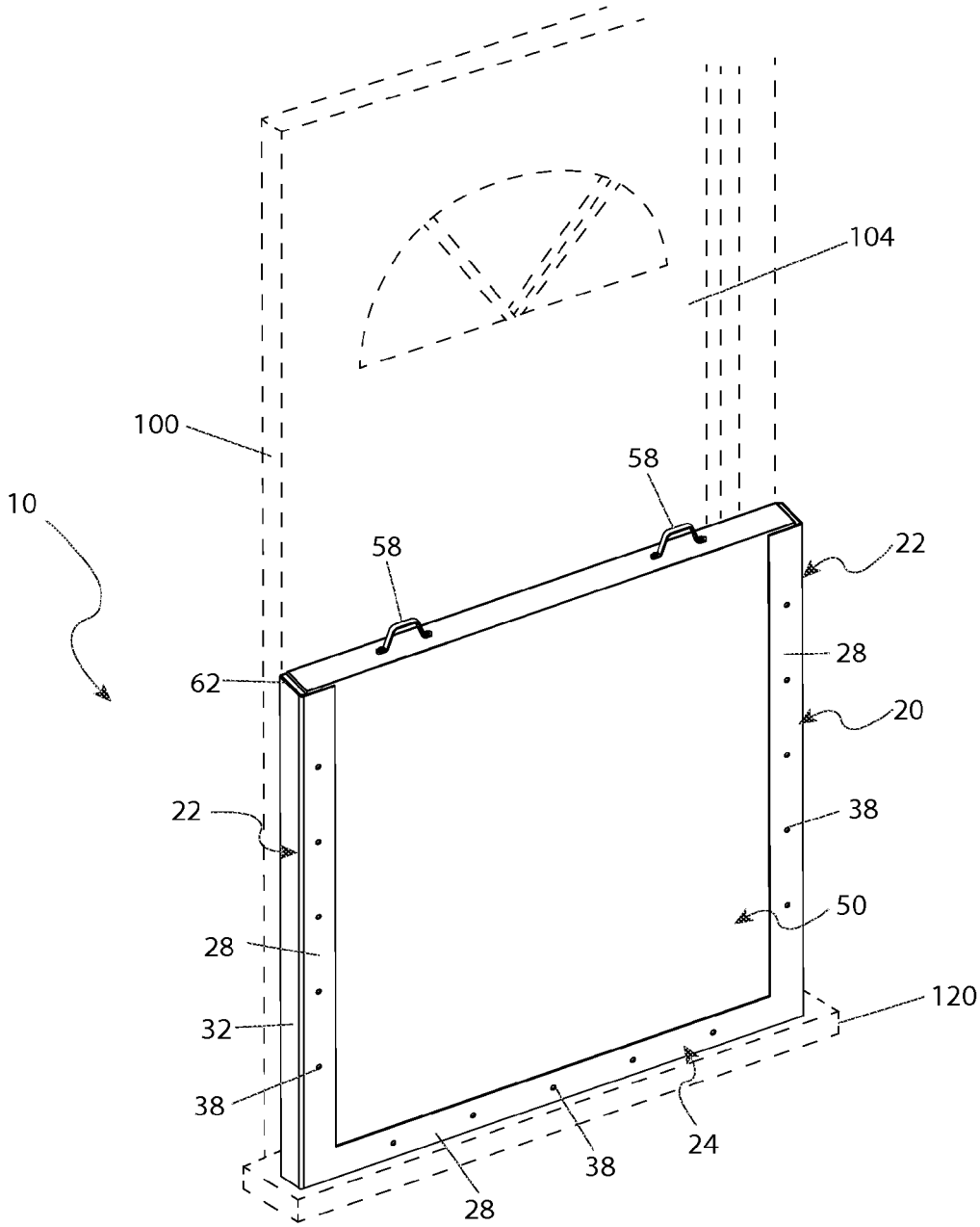
FIG. 1 is an environmental view of a flood gate system for a doorway 10 in accordance with the preferred embodiment of the present invention.

10 system
20 slide panel guide
22 side member
24 base member
26 first side flange
28 second side flange
32 web member
34 throat
36 first aperture
38 second aperture
42 third aperture
46 threaded fastener
50 slide panel
54 blocking
52 core
56 sheathing
58 handle
62 seal
100 building
104 door
120 pad

DETAILED DESCRIPTION OF THE PREFERRED EMBODIMENT

Figure 2:
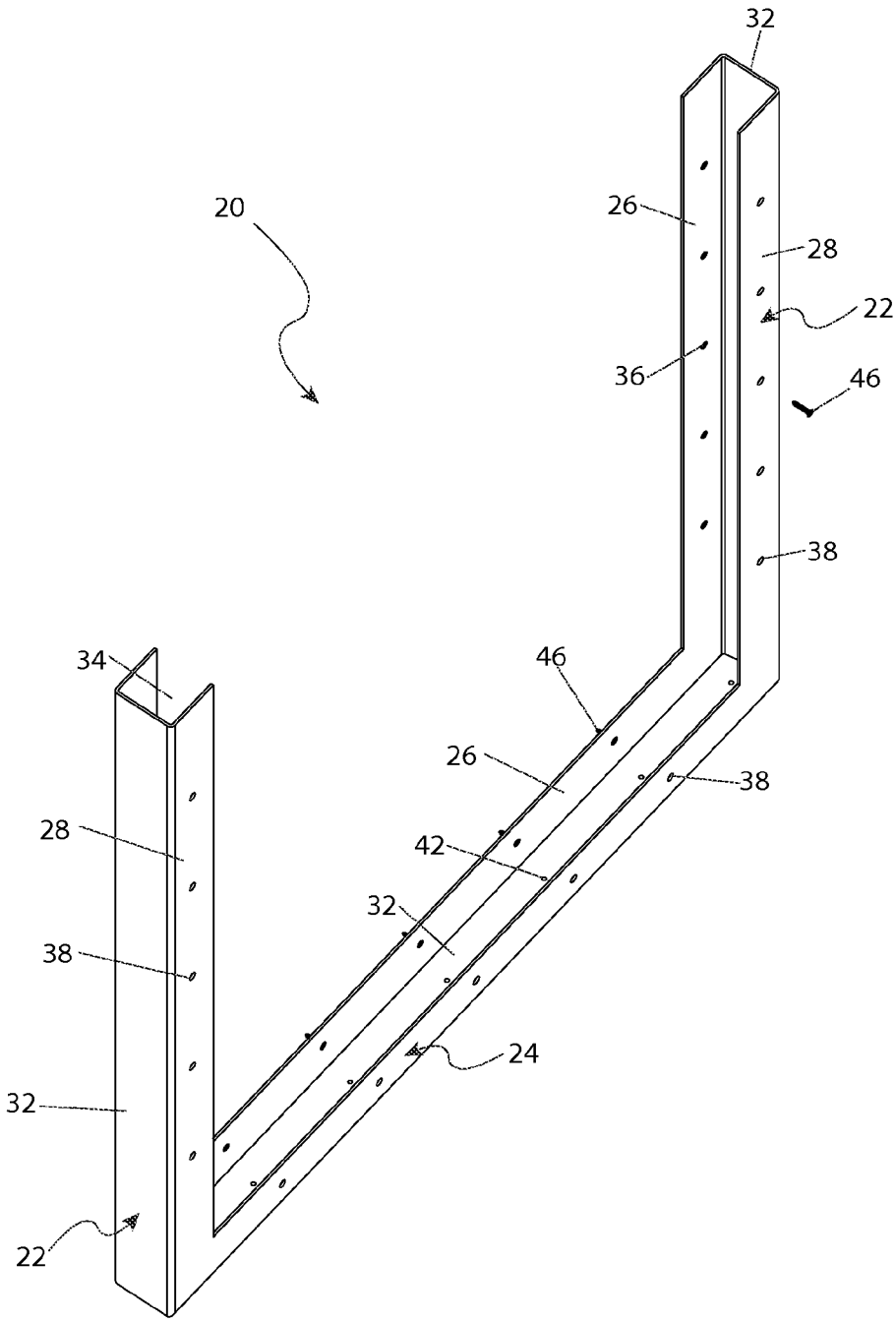
FIG. 2 is an isometric view of a slide panel guide 20 of the flood gate system for a doorway 10 attached to a building 100 in accordance with the preferred embodiment of the present invention; and, FIG. 3 is an isometric view of a slide panel 50 of the flood gate system for a doorway 10 in accordance with the preferred embodiment of the present invention.
Figure 3:
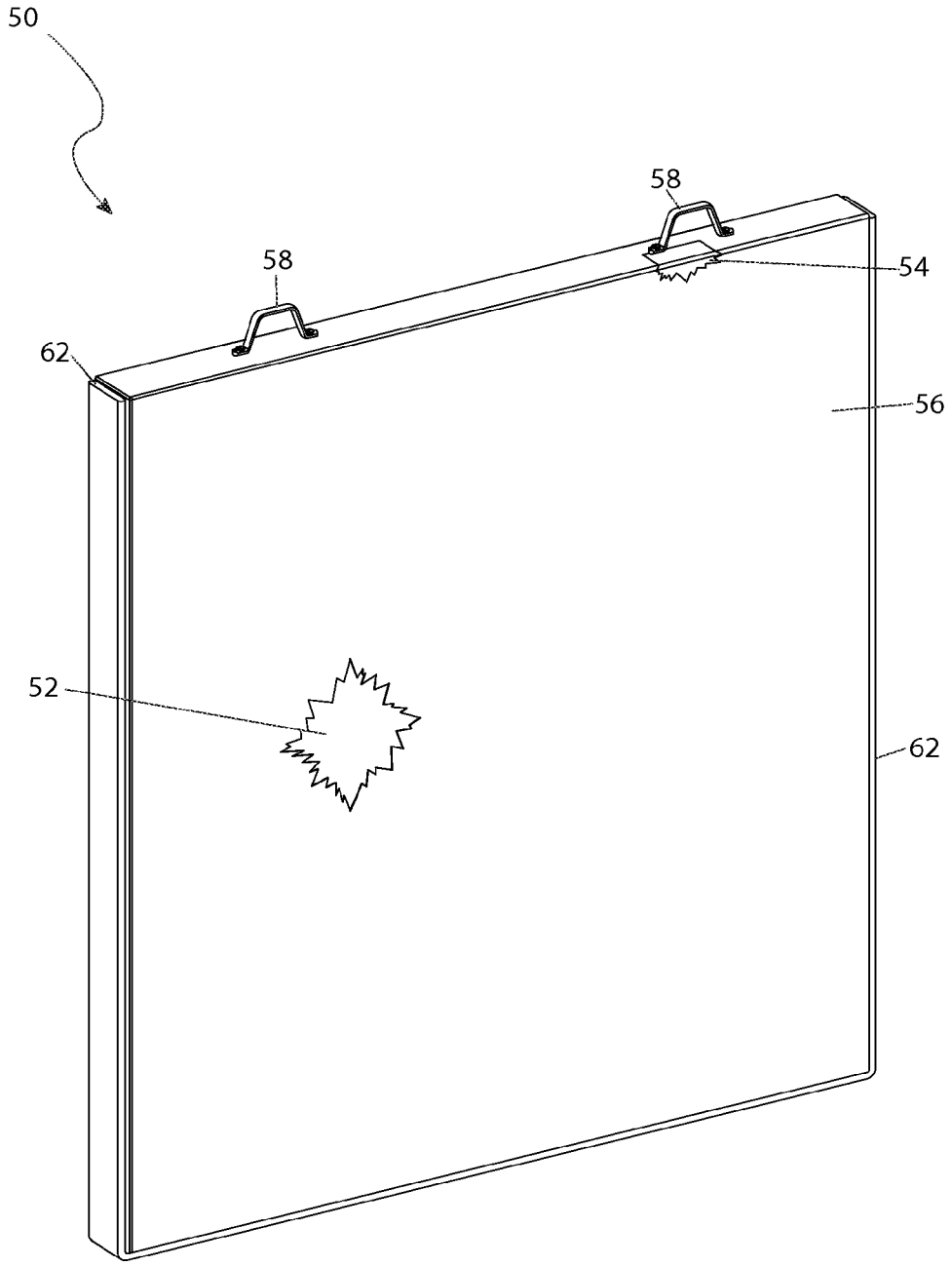

The best mode for carrying out the invention is presented in terms of its preferred embodiment, herein depicted within FIGS. 1 through 3. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The present invention describes a flood gate system for a doorway (herein referred to as the "system") 10, which provides a means to place a temporary, sealed barrier into a permanent frame at a doorway of a building 100 to obviate the entrance of floodwaters. Referring now to FIG. 1, an environmental view, and FIG. 2, an isometric view of the slide panel guide 20, of the system 10 according to the preferred embodiment of the present invention, are disclosed. The system 10 includes a slide panel guide 20 and a slide panel 50. The slide panel guide 20 is adapted to be attached to the building 100 and the slide panel 50 is inserted into the slide panel guide 20 in order to seal off access to the door 104 so as to not allow water therein. The slide panel guide 20 is configured as a formed, or stamped, metal piece with two (2) parallel vertical side members 22 and an interconnecting horizontal base member 24. Each of the side members 22 and the base member 24 are generally "C"-shaped channels with a first side flange 26 parallel to a second side flange 28 and a perpendicular web member 32 therebetween. The first side flanges 26, the second side flanges 28, and the web members 32 of the two side members 22 and the base member 24 define the finite space between them as the throat 34 of the slide panel guide 20. The slide panel guide 20 is preferably composed of aluminum or some other metal which is both economical and resistant to corrosion. However, other materials, such as an extruded rigid polymer or a high-strength composite, may be utilized without limiting the scope of the system 10.

As shown in FIG. 1, the slide panel guide 20 will be oriented with the first side flanges 26 of the side members 22 and the base member 24 abutting a doorway of a building 100. Disposed in an evenly spaced pattern along the first side flanges 26 is a plurality of first apertures 36, each being countersink as oriented toward the doorway. Disposed in a matching pattern along the second side flange 28 of the side members 22 and the base member 24, is an equal and corresponding plurality of second apertures 38. The second apertures 38 are aligned opposite from the first apertures 36 and are of sufficient size so that a tool, such as a screwdriver, may be inserted through a second aperture 38 to reach and drive a threaded fastener 46 into an opposing first aperture 36 to secure the slide panel guide 20 to the building 100.

It should be appreciated that the second aperture 38 may be larger in diameter than the first aperture 36, or of any comparative size, to permit the proper clearances for the threaded fastener 46 and a driving tool. The threaded fastener 46 would preferably be of a flat head, or countersunk, type in order to thread entirely into its particular first aperture 36 and not have any portion projecting into the throat 34. Additionally, disposed along the web member 32 of the base member 24 in a preferably evenly spaced pattern is a plurality of third apertures 42. These third apertures 42 are countersink on the upper surface of the web member 32 of the base member 24 to allow the heads of the downwardly driven fasteners 46 to be recessed. These downwardly driven fasteners may engage the frame other hard base surface the frame may be attached to.

Referring now to FIG. 3, an isometric view of the slide panel 50, of the system 10 according to the preferred embodiment of the present invention, is disclosed. The slide panel 50 would preferably be composed of a thin gauge metal sheathing 56, such as aluminum sheet, formed around a light-weight core 52, such as a closed-cell polymer foam. It is understood that other materials and methods of construction may be utilized for the sheathing 56, such as an epoxy coated steel sheet, and for the core 52 without limiting the scope of the system 10. It may also be necessary to add some type of framing to the core 52 to increase the structural rigidity of the slide panel 50, however, it is understood that any such eventualities do not modify the scope or intent of the present system 10 and this preferred embodiment does not preclude any other embodiment.

Disposed upon the upper edge of the slide panel 50 are preferably two (2) handles 58 to aid in the manipulation and transport of the slide panel 50. The handles 58 are secured to the slide panel 50 by means of threaded or other type fasteners retained in blocking 54. The blocking 54, as seen in the cut-away portion of FIG. 3, is a reinforcing insert, preferably comprised of wood, or other suitable material, formed into the core 52 to withstand certain loading normally beyond the capacity of the constituent core 52 material.

Disposed along the side and lower edges of the slide panel 50 is a seal 62. The seal 62 may be a single piece or separate but contiguous seals attached to, or incorporated into, the sheathing 56. In this manner, a watertight barrier is formed between the slide panel 50 and the side members 22 and the base member 24 of the slide panel guide 20 after the slide panel 50 has been inserted into the slide panel guide 20. The seals may be configured to have any grooves, channels, or other surface features so as to optimize the exclusion of water and debris from the system 10. Alternately, the seals may extend to some portion of the front and the rear faces of the slide panel 50 so as to form a barrier which would involve the first side flange 26 and the second side flange 28 of the members 22, 24.

The preferred embodiment of the present invention can be utilized in a simple and straightforward manner with little or no training. A layer of a substance, such as caulk, would be applied to the face of the first side flange 26 of each member 22, 24 prior to securing the slide panel guide 20 to the building 100 so as to fill any gaps or irregularities to achieve a water-tight seal. The substance used to achieve this seal would preferably not shrink upon setting or drying and would maintain good adhesion between the first side flange 26 and the building 100 over an extended period of time, such as a good quality silicone or latex caulk. However, the substance used for this sealing is not the subject of the present system 10 and as such may encompass any material, or materials, capable of bringing about the water-tight seal.

As a preparatory step to the installation of the slide panel guide 20 on a building 100, a pad 120 would have to be prepared. The pad 120 is a new, or an existing block, preferably composed of concrete, into which threaded inserts have been secured for the purpose of retaining the threaded fasteners 46 installed in the base flange 32 of the base member 24. The requirements of the pad 120 would be that it be essentially coplanar with the base flange 32 of the base member 24 after the slide panel guide 20 is attached to the building 100. Prior to attaching the slide panel guide 20 to the building 100 water-tight seals, as previously discussed, would be installed between the slide panel guide 20 and the building 100 and between the slide panel guide 20 and the pad 120.

After initial purchase or acquisition of the system 10, it would be installed as indicated in FIG. 1. The method of installing and utilizing the system 10 may be achieved by performing the following steps: acquiring a model of the system 10 having a size to adequately cover the desired door; preparing the pad 120 to accept the base member 24 of the slide panel guide 20 by making the necessary adjustments to the level of the pad 120 and installing the necessary threaded inserts to retain the threaded fasteners 46; using the slide panel guide 20 as a template and marking the locations for holes to be drilled into the building 100 for threaded fasteners 46; making the appropriate sized holes depending on the materials of construction of the building 100 for the threaded fasteners 46; positioning the slide panel guide 20 against the building and pad 120 with caulk or other sealing material in place; fastening the slide panel guide in position by securing the threaded fasteners 46 into the walls of the building 100 and into the pad 120; and prior to the weather event or other such happenstance which results in flooding, installing the slide panel 50 into the throat 34 of the slide panel guide 20 using the handles 58. The slide panel 50 may be removed from the slide panel guide 20 and stored in a convenient location after the flood has subsided. Subsequent usage of the system 10 will not require execution the steps involved with attaching the slide panel guide 20 to the building 100.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A flood gate system for a doorway of a building, comprising:

a slide panel guide affixed to a frame of said doorway and to a floor surface, comprising:

a pair of parallel vertical side members with a horizontal base member disposed therebetween;

wherein each said vertical side member further comprises:

a first vertical side member, each first vertical side member having a first plurality of apertures, each first plurality of apertures receives a fastener for retaining said first vertical side members to said frame;

a second vertical side member, each second vertical side member having a second plurality of apertures aligned with said first plurality of apertures, wherein:

each of said second plurality of apertures is of sufficient size to allow an unrestricted passage of said fasteners; and, each of said second plurality of apertures further allows an unrestricted access of a driving tool through said second vertical side member to reach said fasteners;

a vertical web member;

wherein each said vertical side member is formed as a channel in cross-section; and, wherein said channel of each said vertical side member is inwardly juxtaposed one to the other;

wherein said horizontal base member further comprises:

a first horizontal side member, each first horizontal side member having a third plurality of apertures, each third plurality of apertures receives a fastener for retaining said first horizontal side members to said frame;

a second horizontal side member, each second horizontal side member having a fourth plurality of apertures aligned with said third plurality of apertures, wherein:

each of said third plurality of apertures is of sufficient size to allow an unrestricted passage of said fasteners; and, each of said third plurality of apertures further allows an unrestricted access of a driving tool through said second horizontal side member to reach said fasteners;

a horizontal web member;

wherein said horizontal base member is formed as a channel in cross-section; and, wherein said channel of said horizontal base member is upwardly oriented;

a throat space formed by said channel cross-sections of said side members and said base member, wherein said throat is adapted to slidingly receive and retain said slide panel;

a fifth plurality of apertures disposed on said horizontal base member, each adapted to receive a downwardly driven fastener for retaining said base member;

a slide panel adapted to be inserted into said slide panel guide, comprising:

solid core enclosed in a sheath;

reinforcing blocking disposed within said core; and, at least one handle disposed upon an upper edge of said slide panel and secured to said blocking;

wherein said sheath is adapted to add rigidity to said core and provide a weather resistant outer surface;

a seal attached to said slide panel; and, a slide panel guide seal;

wherein said seal forms a water tight barrier between said slide panel and said slide panel guide;

wherein said slide panel guide seal provides a secondary sealing means to said slide panel seal; and, wherein said system provides a barrier at said frame of said doorway to obviate the entrance of floodwaters.

* * * * *